US008327758B2

(12) United States Patent
Mosca et al.

(10) Patent No.: US 8,327,758 B2
(45) Date of Patent: Dec. 11, 2012

(54) TAPE STRAPPING MACHINE

(75) Inventors: Timo Mosca, Elztal-Neckarburken (DE); Lorenz Helmrich, Waldbrunn (DE); Peter Lüdtke, Buchen-Götzingen (DE)

(73) Assignee: Maschinenfabrik Gerd Mosca AG, Waldbrunn (DE)

( * ) Notice: Subject to any disclaimer, the term of this patent is extended or adjusted under 35 U.S.C. 154(b) by 664 days.

(21) Appl. No.: 12/310,004

(22) PCT Filed: Aug. 9, 2007

(86) PCT No.: PCT/EP2007/058286

§ 371 (c)(1),
(2), (4) Date: Nov. 23, 2009

(87) PCT Pub. No.: WO2008/019991

PCT Pub. Date: Feb. 21, 2008

(65) Prior Publication Data

US 2010/0147164 A1 Jun. 17, 2010

(30) Foreign Application Priority Data

Aug. 15, 2006 (DE) ..... 10 2006 038 318

(51) Int. Cl.
*B65B 13/04* (2006.01)

(52) U.S. Cl. ..... 100/2; 100/26; 100/29; 53/589

(58) Field of Classification Search ..... 100/25, 100/26, 29, 32, 33 R, 33 PB, 2; 53/589
See application file for complete search history.

(56) References Cited

U.S. PATENT DOCUMENTS

| | | | | |
|---|---|---|---|---|
| 4,244,773 | A * | 1/1981 | Siebeck et al. | 156/522 |
| 5,078,057 | A * | 1/1992 | Pearson | 100/25 |
| 5,249,518 | A * | 10/1993 | Abrams | 100/26 |
| 6,073,425 | A * | 6/2000 | Chin-Chang et al. | 53/589 |
| 6,415,712 | B1 * | 7/2002 | Helland et al. | 100/26 |
| 6,655,117 | B2 * | 12/2003 | Hoshino | 53/589 |
| 6,951,170 | B2 * | 10/2005 | Lininger et al. | 100/26 |
| 2005/0229551 | A1 * | 10/2005 | Stauber | 53/589 |

FOREIGN PATENT DOCUMENTS

| | | | |
|---|---|---|---|
| AT | 314 432 | B | 4/1974 |
| CH | 662 323 | A5 | 9/1987 |
| DE | 21 55 367 | | 5/1973 |
| DE | 33 46 598 | A1 | 10/1984 |
| DE | 41 00 276 | A1 | 7/1991 |
| DE | 601 08 476 | T2 | 3/2006 |
| EP | 1 207 107 | B1 | 5/2002 |

(Continued)

*Primary Examiner* — Jimmy T Nguyen
(74) *Attorney, Agent, or Firm* — Muirhead and Saturnelli, LLC

(57) ABSTRACT

An apparatus for strapping an article by means of a flat tape includes least one tape guide frame having a flat tape guide passage, and a tape drive for feeding the tape into the tape guide passage, wherein arranged at the tape guide frame is an opening device which opens a narrow side of the tape guide passage, and a method of strapping an article with such an apparatus. The opening device may include at least one cover element which is movably secured to the tape guide frame and which is movable from a closed position in which it covers the narrow side of the tape guide passage into an open position in which it opens the narrow side of the tape guide passage. In that way a fresh tape loop can be introduced into the tape guide passage before the welding operation is concluded.

12 Claims, 9 Drawing Sheets

FOREIGN PATENT DOCUMENTS

| | | | |
|---|---|---|---|
| EP | 1 249 397 | B1 | 1/2005 |
| JP | 48-14240 | | 4/1973 |
| JP | 2003200904 | A | 7/2003 |
| WO | WO 2004/002829 | A1 | 1/2004 |

* cited by examiner

Fig. 0001
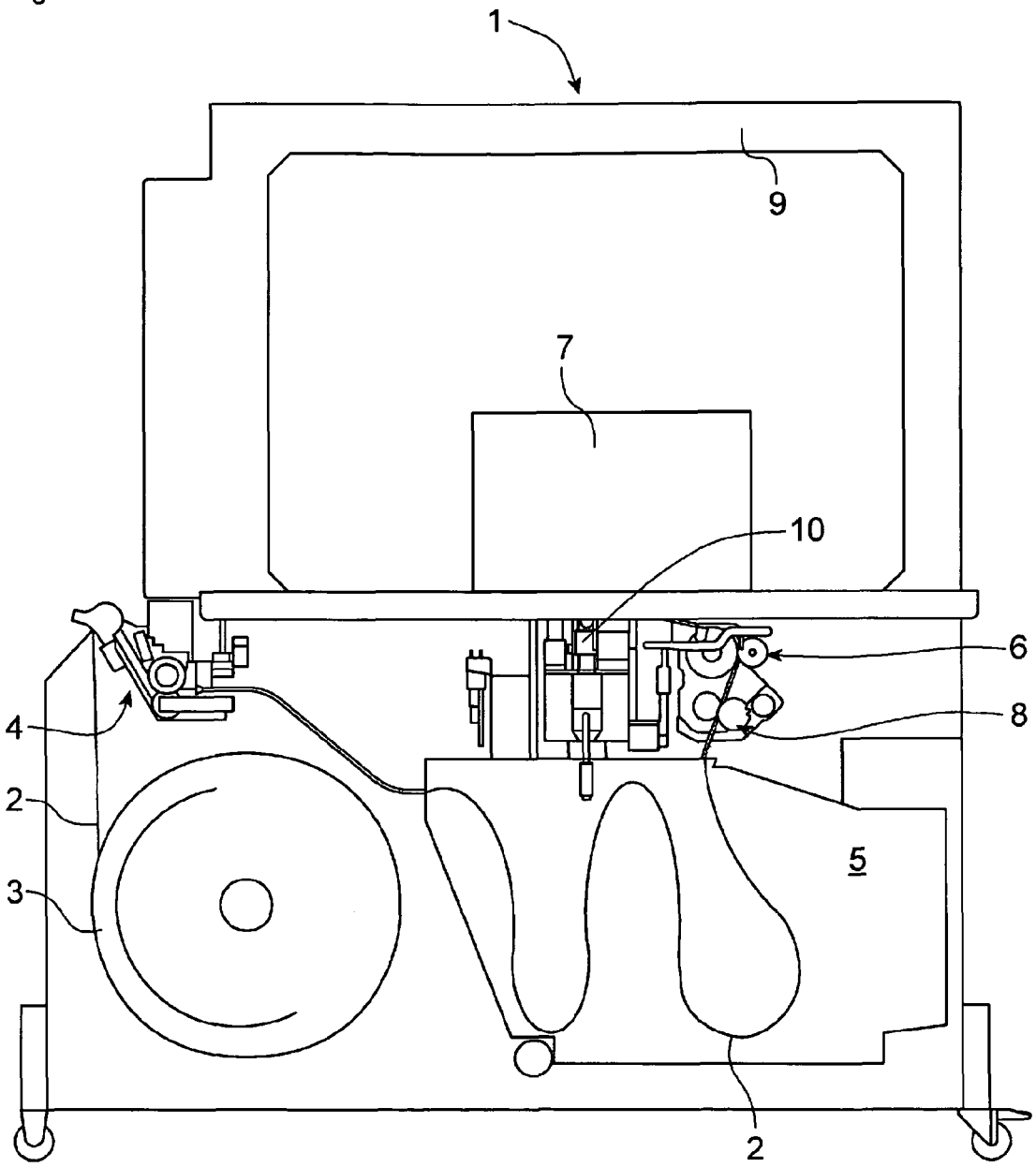

Fig. 0002
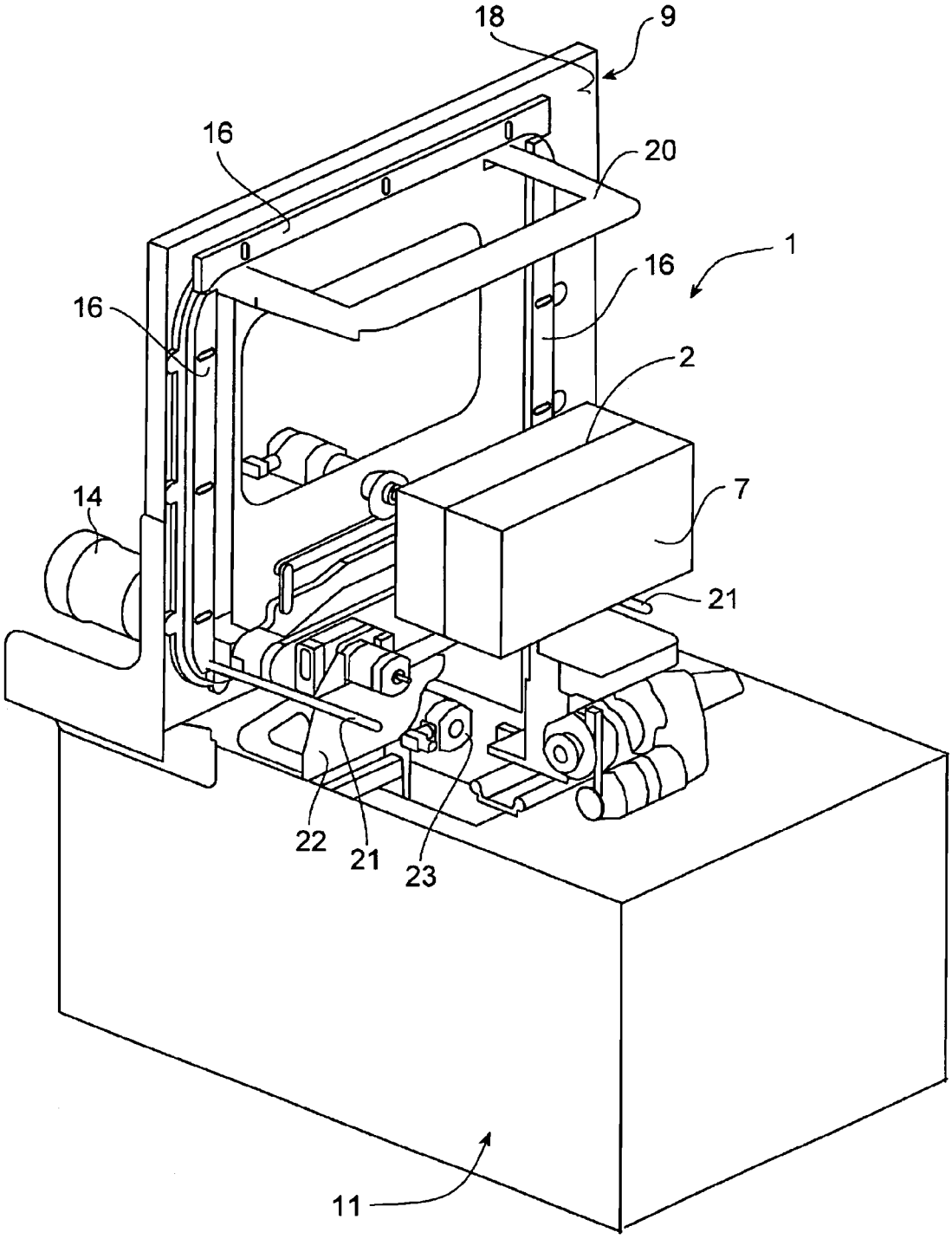

Fig. 0003
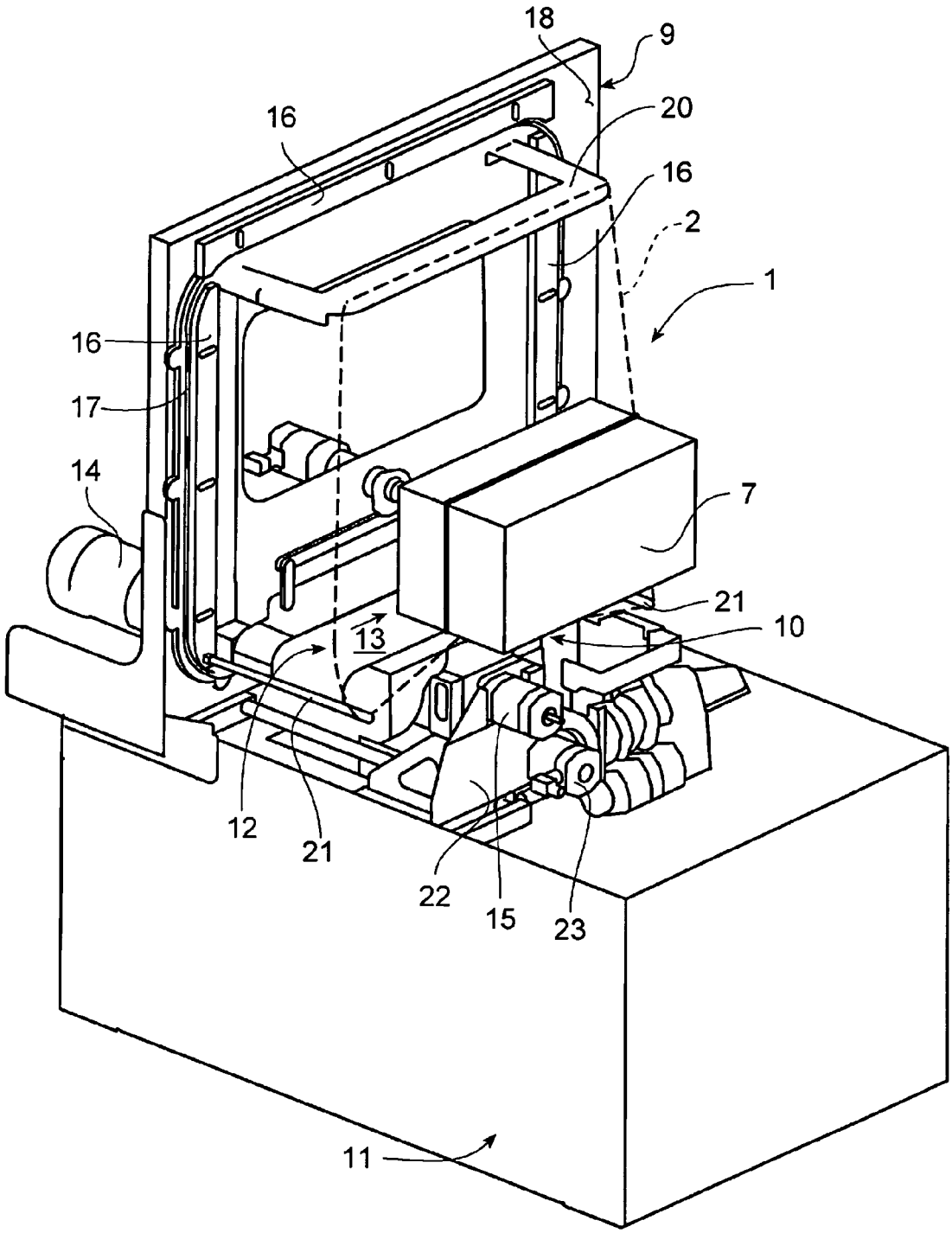

Fig. 0004
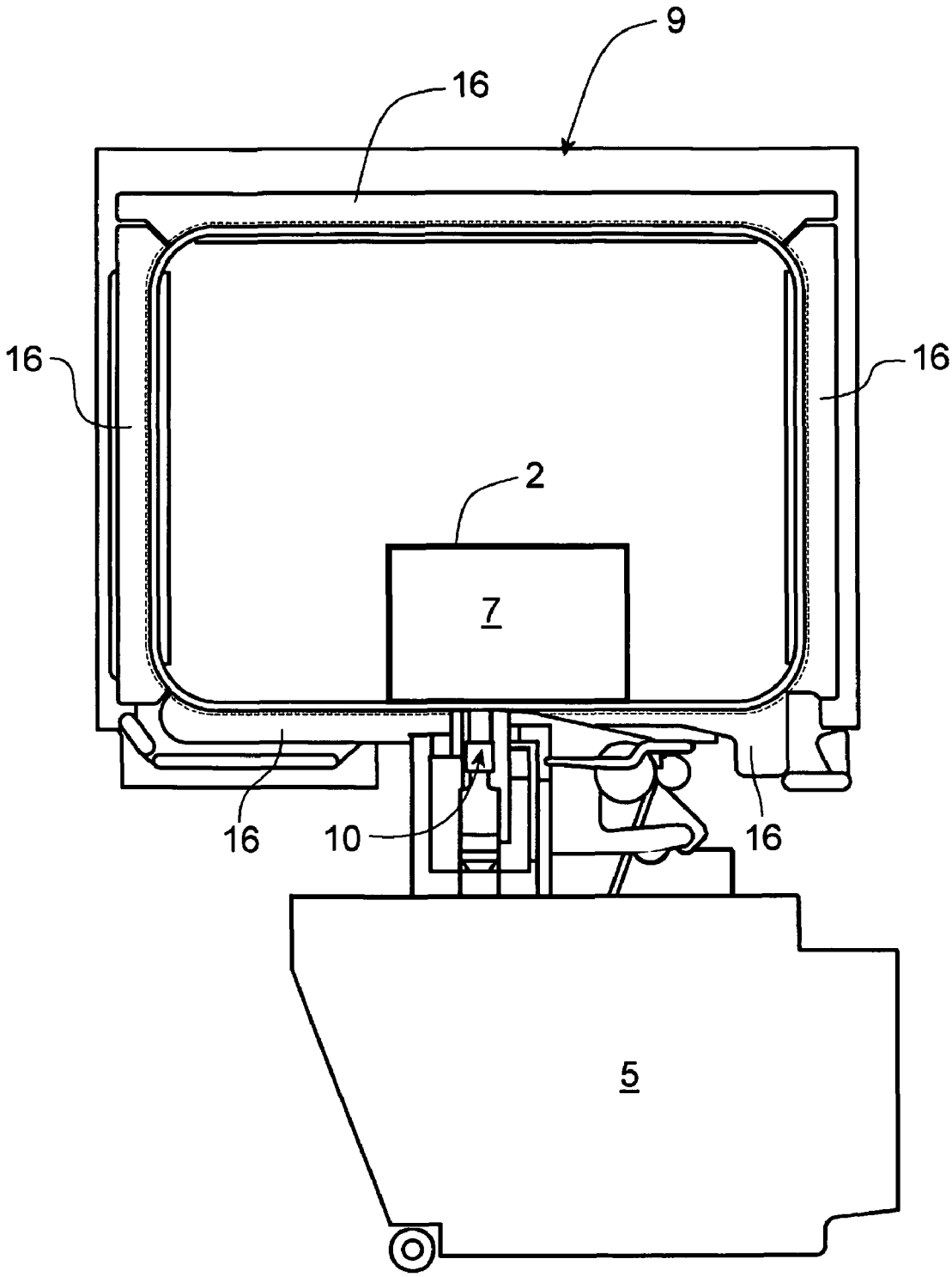

Fig. 0005
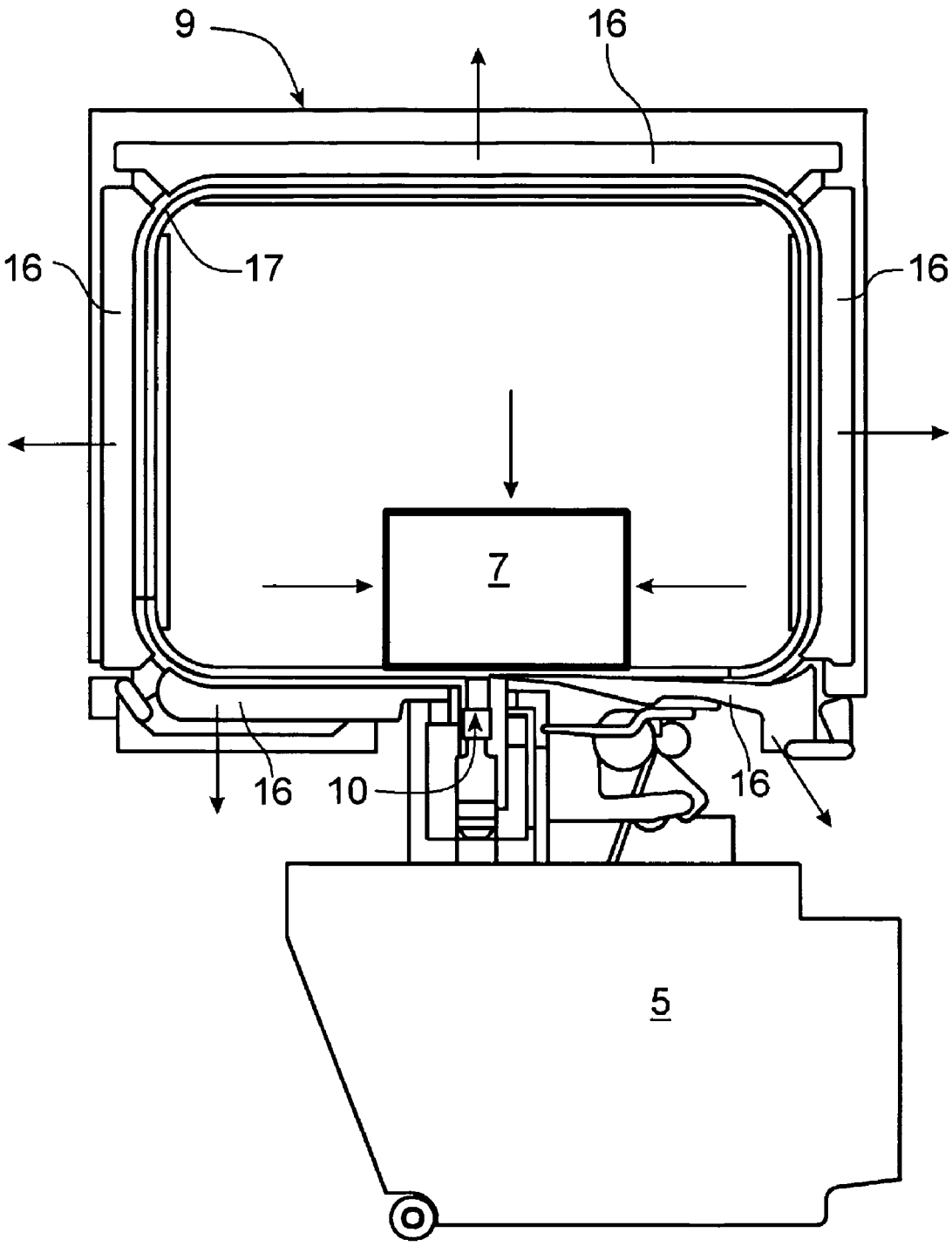

Fig. 0006
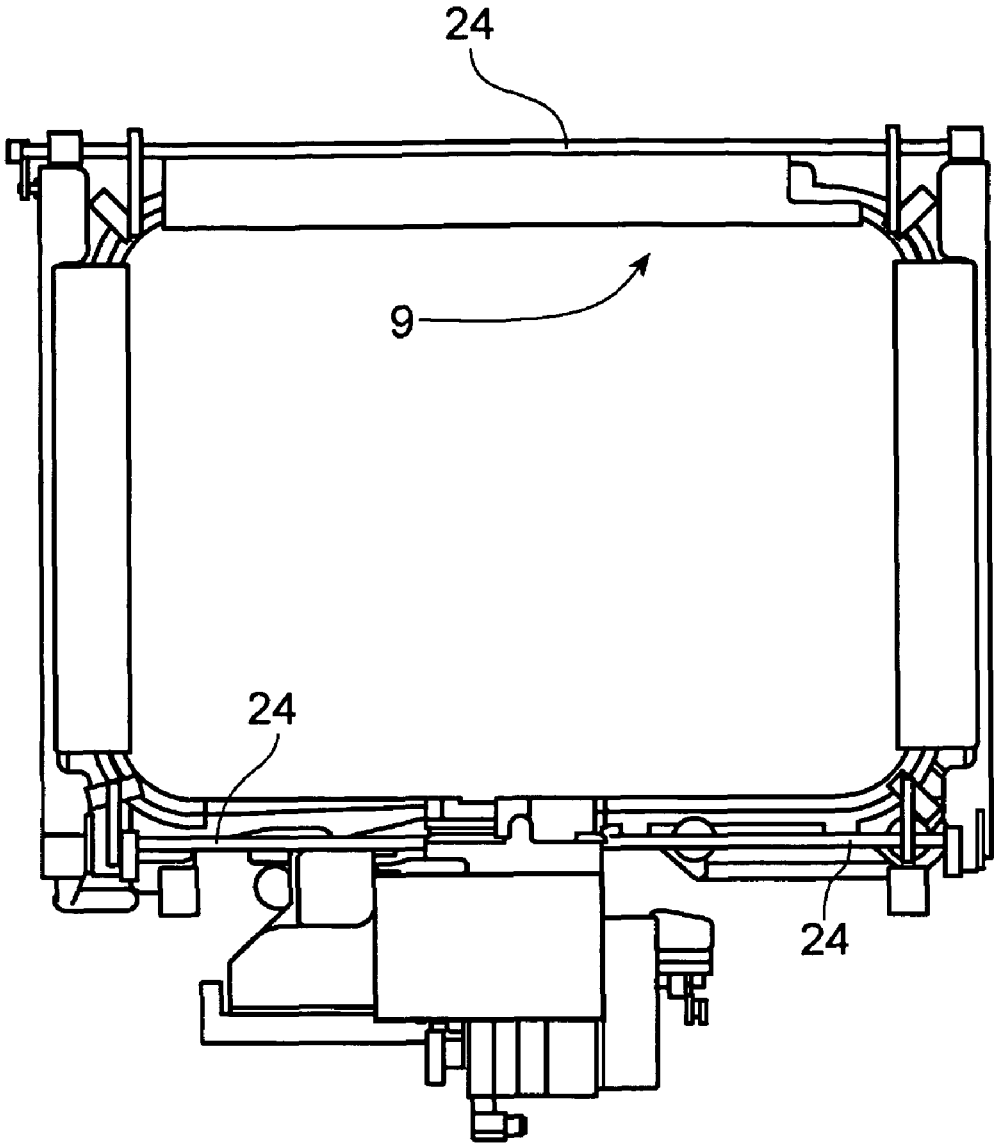
Fig. 0007
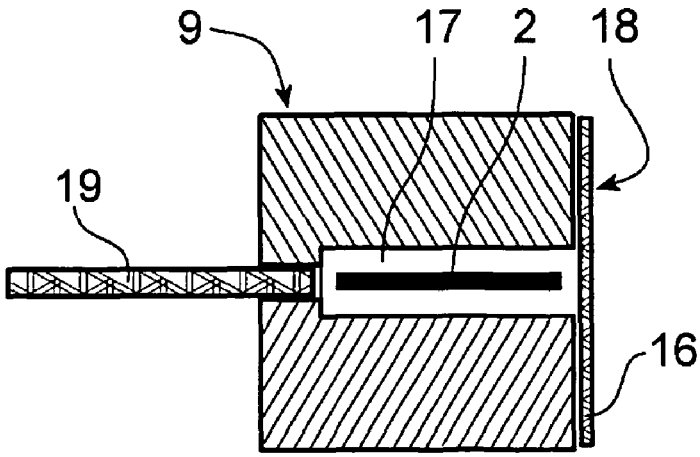

Fig. 0008
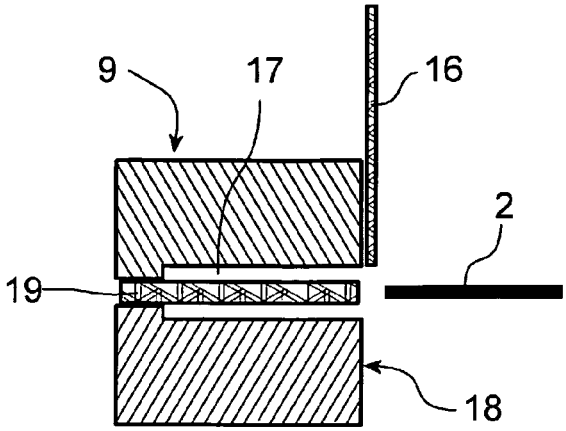
Fig. 0009
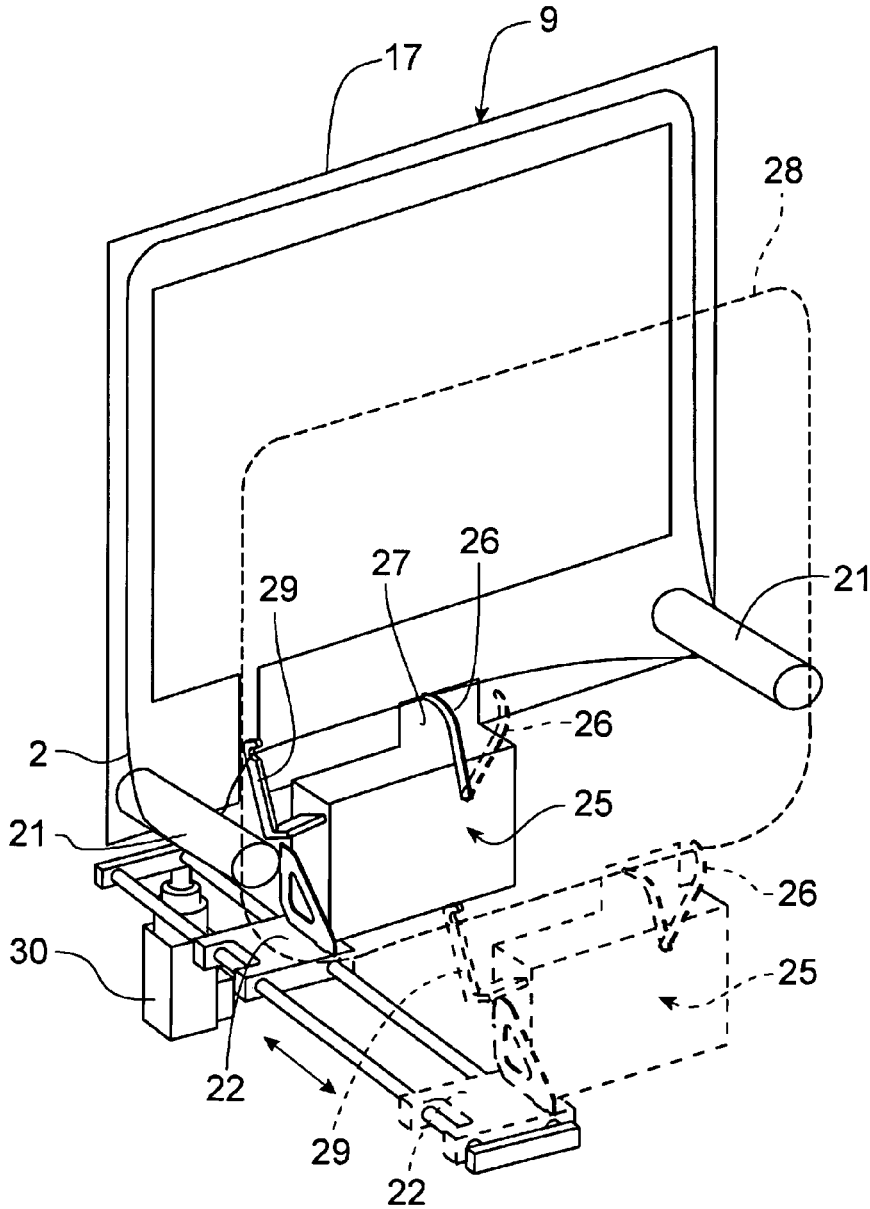

Fig. 0010
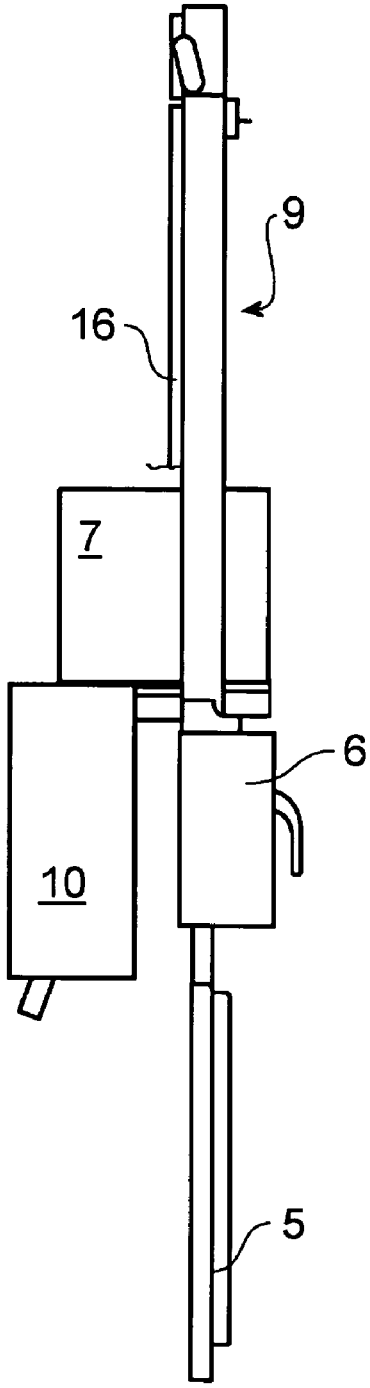

Fig. 0011
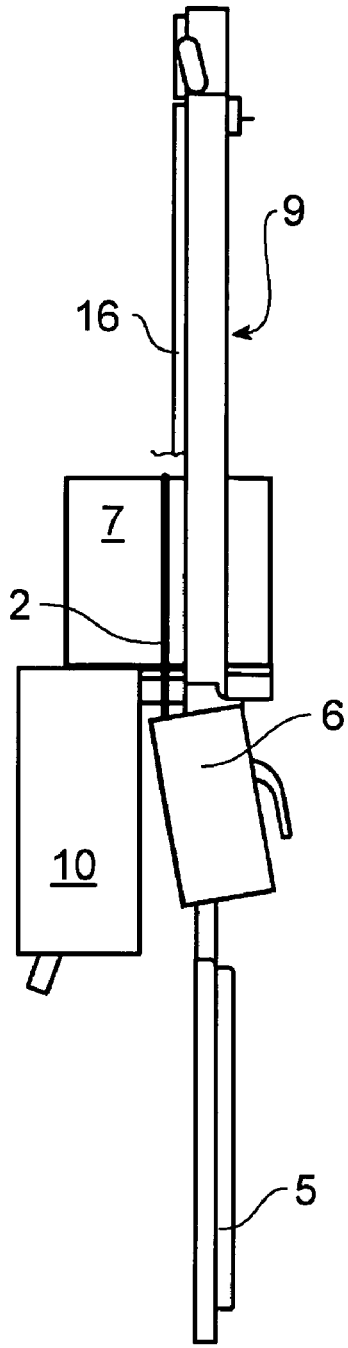

TAPE STRAPPING MACHINE

This is a National Phase Application in the United States of International Patent Application No. PCT/EP2007/058286 filed Aug. 9, 2007, which claims priority on Germany Patent Application No. 10 2006 036 318.4 filed Aug. 15, 2006. The entire disclosures of the above patent applications are hereby incorporated by reference.

TECHNICAL FIELD

This application relates to the field of strapping articles with a strapping tape.

BACKGROUND OF THE INVENTION

Apparatuses of that kind are used for strapping articles such as stacks of newspapers, packets or the like. The articles are usually transported on a conveyor into the tape guide frame so that they project through the plane of the tape guide frame. A flat strapping tape is fed to the tape guide passage in the tape guide frame by means of the tape drive. The tape guide frame then opens, the tape loop formed being liberated in the radially inwardly directed direction and passing around the article to be strapped. The tape loop is then contracted until it is tightened firmly around the article to be strapped. In that condition the tape loop formed is separated from the supply of tape and the two ends of the tape loop are pressed against each other and joined together. The connection between the ends of the loop is in most cases effected by welding.

DE 601 08 476 T2 describes such a strapping machine in which the opening device for the tape guide frame opens a narrow side of the tape guide passage. As can be seen from FIGS. 10 to 12 of the drawing of that publication, the tape guide passage is accommodated in a frame-like, arcuate element which is substantially of a C-shaped cross-section and encloses the tape guide passage. The C-shaped element when viewed in cross-section is pressed with the two free ends of the mutually parallel limbs against what is referred to as an arc plate. The arc plate forms a stationary component of the tape guide frame. The C-shaped elements with the tape guide passage can be pulled away from the arc plate in the direction of the two parallel limbs thereof. When the C-shaped elements are pulled away from the stationary arc plate, the passage between the two mutually parallel limbs of the C-shaped elements is opened. The tape loop remains in the proximity of the arc plate and is exposed in a radial direction at its inside. It can then be pulled radially inwardly around the article to be strapped.

The disadvantage of that structure is that the tape lies in the same plane upon being shot into the tape guide passage and upon being released, tightened and closed. The closure device with which the ends of the tape loop are closed therefore prevents a longitudinal portion of the strapping tape from being shot into the tape guide frame to form a fresh tape loop. Consequently the strapping operation including closure of the tape loop is first completely terminated before a fresh tape loop is shot into the tape guide frame. Accordingly it would be desirable to provide an apparatus and a method for strapping articles which permit a greater operating speed.

SUMMARY OF THE INVENTION

According to the system described herein, an apparatus for strapping an article by means of a flat tape includes at least one tape guide frame having a flat tape guide passage, and a tape drive for feeding the tape into the tape guide passage, wherein arranged at the tape guide frame is an opening device which opens a narrow side of the tape guide passage.

The opening device may include at least one cover element which is movably secured to the tape guide frame and which is movable from a closed position in which it covers the narrow side of the tape guide passage into an open position in which it opens the narrow side of the tape guide passage.

Consequently, unlike the situation in the state of the art, a C-shaped element with the tape guide passage is not moved itself. In accordance with the system described herein the tape guide passage is stationary. Arranged at the tape guide passage is a movable cover element which in an open position opens or exposes the narrow side of the tape guide passage. Consequently the stationary tape guide passage can be opened at a narrow side without being displaced in that situation.

This apparatus requires the tape loop formed to issue laterally from the tape guide passage. It is therefore displaced into a plane which is disposed laterally of the plane of the tape guide passage. During subsequent handling of the tape loop, that is to say when tightening the tape loop and when closing the tape loop with a closure assembly, in the case of a tape guide frame according to the system described herein tape material can be freshly inserted into the tape guide passage before the closure operation in which the ends of the loop are joined together is concluded.

For the apparatus according to the system described herein, the configuration according to the system described herein of the tape guide frame affords a highly effective possible way of shortening the processing time for loop formation and strapping of the article.

In a practical embodiment the cover element is secured displaceably to the tape guide frame. Alternatively the cover element can be secured pivotably to the tape guide frame.

In practice the tape guide frame can include a plurality of limbs, at least one cover element being secured to each limb of the tape guide frame. In that case there can be provided an opening drive which synchronously drives all cover elements.

In addition at least one ejector can be arranged on the tape guide frame, which ejector pushes the tape loop formed in the tape guide passage through the open narrow side out of the tape guide passage when the opening device is in the open position. During the operation of shooting in the tape the ejector is withdrawn from the tape guide passage. After the narrow side of the tape guide passage is opened the ejector is urged into the tape guide passage from the side opposite to the open side, and in so doing urges the tape loop out of the plane of the tape guide passage into a second plane parallel thereto. In that second plane the loop is contracted and tightened around the article to be strapped.

In that case in a practical embodiment the tape drive can be movable from a first position in which the tape is fed to the tape guide passage into a second position in which the loop formed is tightened around the article. After separation of the loop from the article the tape drive can be moved back into the first position in order to feed a fresh tape loop to the tape guide passage before the previously formed loop is closed. If the tightening and closure plane is only a few millimeters beside the plane of the tape guide passage, it can be sufficient for the tape drive to be pivotable.

Alternatively the tape drive can be displaceable. In that case the tape loop can be displaced from the tape guide frame laterally into a strapping plane in which the article to be strapped is already disposed. In that way it is possible to implement longitudinal strapping procedures in which an article is strapped with a tape loop in the direction of the conveyor.

As mentioned in practice the apparatus according to the system described herein has a closure assembly for joining the ends of the tape loop. In a practical embodiment the closure assembly is in the form of a welding device.

According further to the system described herein, a method of strapping an article by means of a tape is provided in which:

- a tape is fed to a tape guide passage from a tape supply to form a tape loop,
- the tape loop is tightened around the article,
- the tightened tape loop is cut away from the tape supply,
- to close the tightened tape loop the ends thereof are joined together.

According to the system described herein, prior to the conclusion of the operation of closing the tightened tape loop, tape is freshly fed to the tape guide passage from a tape supply to form a tape loop.

As mentioned above in a practical embodiment a narrow side of the tape guide passage can be opened prior to tightening of the tape loop, and the tape issues from the tape guide passage through said narrow side.

For that purpose at least one movable cover element can be secured to the tape guide frame, said cover element being moved from a closed position in which it covers the narrow side of the tape guide passage into an open position in which it opens the narrow side of the tape guide passage. In that respect the cover element can be displaced or pivoted on the tape guide frame. If the cover frame includes a plurality of cover elements, an opening drive can synchronously drive all those cover elements.

As mentioned hereinbefore there can be at least one ejector which pushes the tape loop formed in the tape guide passage through the open narrow side and out of the tape guide passage.

In practice a tape drive can be moved from a first position into a second position and back, wherein in the first position it feeds the tape to the guide passage and in the second position it tightens the loop formed around the article.

The tape drive can be pivoted or displaced between the two positions.

BRIEF DESCRIPTION OF THE DRAWINGS

Embodiments of the system described herein are explained hereinafter with reference to the accompanying drawings in which:

FIG. 1 shows a diagrammatic front view of a strapping machine,

FIG. 2 shows a perspective view of a strapping machine according to an embodiment of the system described herein in which a strapping tape is fed to the tape guide frame, FIG. 3 shows a perspective view of a strapping machine according to an embodiment of the system described herein in which a finished tape loop is displaced towards the strapping plane, FIG. 4 shows a front view of the closed tape guide frame, FIG. 5 shows a front view of the open tape guide frame, FIG. 6 shows a rear view of the tape guide frame, FIG. 7 is a diagrammatic view showing the principle of the tape guide frame in the closed position in cross-section, FIG. 8 shows a view corresponding to FIG. 7 of the tape guide frame in the open position, FIG. 9 shows a perspective view of the holding means with a tape loop held therein, FIG. 10 shows a side view of a further embodiment of the system described herein with a pivotable tape drive in the starting position, and FIG. 11 shows a view corresponding to FIG. 10 with the pivoted tape drive.

DETAILED DESCRIPTION OF VARIOUS EMBODIMENTS

The strapping machine 1 shown in FIG. 1 serves for strapping articles 7 with a tape 2 which is drawn off a supply roll 3 by a feed-in device 4, and is fed to a tape magazine 5. From there the tape is fed by means of a tape feed device 6 through a tightening device 8 to a tape guide passage in a tape guide frame 9 so that the tape forms a loop. The tape is then retracted by the drive of the tape feed device 6 so that the tape loop bears snugly against the article 7. The tightening device 8 is now activated so that the tape loop is drawn around the article 7 with a predetermined high level of tightening force. The tape feed device 6 and the tightening device 8 jointly form the tape drive. They can also be combined together to afford a drive device.

The tightened loop is then cut off the tape supply. The leading part of the loop is joined to the end of the loop by means of a closure assembly 10. In practice the closure assembly 10 for example comprises a welding device which welds together the two ends of the packaging tape loop formed. The closure assembly 10 welds the film-like plastic material constituting the strapping tape. The conveyor for the article 7 is not shown in FIG. 1.

FIGS. 2 and 3 show perspective views of the strapping machine 1 according to various embodiments of the system described herein. The strapping machine 1 includes a frame structure 11. The frame structure 11 is usually provided with cladding means or cover members. The tape guide frame 9 is arranged on the frame structure 11. The tape guide frame 9 is disposed in a vertical plane laterally of a conveyor 12. The conveyor is only shown in FIG. 3 for the sake of enhanced clarity. The conveyor 12 includes a conveyor belt 13 which is moved by a conveyor motor 14 in the conveyor direction indicated on the conveyor belt 13. Arranged beside the illustrated conveyor belt 13 is a second corresponding conveyor belt which is not shown in FIG. 3 for the sake of clarity. Extending between the two conveyor belts is a gap through which the tape loop passes upon being strapped around the article 7.

Arranged beneath the plane of the conveyor 12 is a drive motor 15 for the tape 2, which is associated with the tape feed device 6 (see FIG. 1). The drive motor 15 is arranged on a carriage 22 which is displaceable transversely with respect to the conveyor direction. In FIG. 2 the carriage 22 is in a position in which the drive roller arranged on the drive shaft of the drive motor 15 is in the plane of the strapping frame 9. The drive motor 15 feeds to the tape guide frame 9 a portion of the tape 2, which forms a closed loop in the tape guide passage. The two ends of the closed loop are engaged by a holding means beneath the tape guide frame 9, which is described in detail hereinafter. During the feed of the tape 2 into the tape guide frame 9 cover elements 16 cover the tape guide passage formed in the tape guide frame 9.

In FIG. 3, in comparison with FIG. 2, the upper cover elements 16 are displaced upwardly and the lateral cover elements 16 are displaced towards the centre of the frame. In that opening the tape guide passage 17 is opened and the tape 2 can issue from the tape guide passage 17.

FIGS. 7 and 8 diagrammatically show the two different conditions of the tape guide passage 17, namely the closed condition in FIG. 7 and the open condition in FIG. 8. The tape guide frame 9 is shown in section here. The tape guide frame 9 has an inner tape guide passage 17 which is open to the narrow side 18 of the tape guide frame 9, which faces the strapping plane. In the closed condition (FIG. 7) the open side of the tape guide passage 17 is covered by the above-mentioned cover element 16. In that position the tape 2 is fed to the passage 17 to form therein a closed tape loop.

The cover element 16 is then displaced so that the side 18 of the tape guide passage 17 facing the strapping plane is opened (see FIG. 8). The tape 2 can now issue from the tape guide passage 17 on the side 18. Ejectors 19 can be provided at one or more positions of the tape guide passage 17, the ejectors being pushed into the tape guide passage 17 after opening thereof (see FIG. 8) and in that situation pressing the tape 2 out of the tape guide passage 17.

As in particular FIG. 3 shows adjoining the tape guide frame 9 on the side that faces the strapping plane is an upper bar 20 forming a guide means for the tape loop formed in the tape guide passage 17. Arranged laterally and beneath the conveyor 12 are two guide rods 21 which form further guide means for the tape loop formed.

FIG. 3 shows a view substantially corresponding to FIG. 2 illustrating the strapping machine, in which the drive motor 15 is displaced into a position beneath the conveyor 12. At the same time as the drive motor 15, the holding means described hereinafter is displaced into the region beneath the conveyor 12, which firmly holds the tape loop and displaces it along the guide means 20, 21. The entrained loop of the tape 2 is shown in broken line in FIG. 3 and is in the strapping plane at the end of the guide means 20, 21. Upon contraction of the tape loop it slides over the ends of the guide means 20, 21 and can be tightened around the article 7.

The drive motor 15 is arranged together with the holding means on a carriage 22 which is displaceable transversely with respect to the conveyor direction of the conveyor 12 from a portion beneath the tape guide frame 9 into a portion beneath the strapping plane. Also arranged on the carriage 22 is a tightening motor 23 for driving the tightening device when tightening the tape 2.

When the carriage 22 is displaced into its end position beneath the strapping plane the tape 2—as mentioned above—slides from the guide means 20, 21 and can be tightened around the article 7 by the drive motor 15 and the tightening motor 23. The ends of the tape loop tightened around the article 7 are then welded in the closure assembly 10, underneath the article 7. During that welding operation the holding means with the carriage 22 can be pushed back into the position shown in FIG. 2 beneath the tape guide frame 9. During the welding operation a fresh step of shooting tape into the tape guide frame 9 can take place so that a fresh tape loop is formed in the tape guide passage before the article 7 is transported away and out of the strapping position shown in FIGS. 2 and 3.

The identical arrangement can be provided in mirror-image relationship on the other side of the strapping plane (not shown). In that case a second carriage travels from the side at the right in FIGS. 2 and 3, into the strapping plane. That second carriage can supply tape loops to a strapping plane which is displaced by a certain distance in relation to the first strapping plane. Thus, the article 7 can be supplied with two mutually parallel tape loops. Alternatively both carriages are movable into the same strapping plane so that a first loop is transported from the left-hand tape guide frame to the strapping plane and a second loop is transported from the right-hand tape guide frame.

FIG. 4 shows a front view of the tape magazine 5 with the tape guide frame 9 arranged thereabove, with the tape guide passage closed. In this embodiment all cover elements 16 are displaced outwardly to open the tape guide passage. It will be seen that the tape guide frame 9 has four limbs which are at a right angle to each other. Each lateral limb and the upper limb is provided with a respective cover element 16. On the lower limb of the tape guide frame 9 there are two cover elements 16, between which the closure assembly 10 is disposed. The cover elements 16 are displaced in FIG. 4 towards the inside of the tape guide frame 9. In that position they cover the tape guide passage so that a tape loop pan be inserted into the tape guide passage.

In FIG. 5 the cover elements 16 of the tape guide frame 9 are displaced outwardly so that they open or expose the tape guide passage 17. The tape loop can now issue from the tape guide passage and—as shown in FIG. 5—be contracted around the article 7 to be strapped.

FIG. 6 shows the rear side of the tape guide frame 9 on which it is possible to see three thrust rods 24 which are coupled together and which simultaneously displace all four cover elements 16.

FIG. 9 shows the holding means 25 with which the ends of the tape loop 28 formed by the tape 2 can be engaged and transported from the plane of the tape guide frame 9 to the strapping plane. The holding means 25 includes a first clamp having a clamping arm 26 and a support plate 27. The clamping arm 26 is shown in solid lines in the position in the proximity of the tape guide frame, in the clamping position in which it is pushed against the support plate 27 and clamps the end of the tape fast. The clamping arm 26 is shown in broken lines in the open position in which it is pivoted away from the support plate 27. The clamping arm 26 has a slot which extends in the transverse direction of the tape 2 and with which at least the free end of the tape is accommodated and pressed against the support plate 27. The end of the tape loop 28, that is joined to the tape supply, can be clamped in the same slot of the clamping arm 26 or a second slot parallel thereto. If the closure assembly with the holding means 25 is displaceable on the carriage 22 the end of the tape that is joined to the tape supply can be engaged directly by the clamping means of the assembly. An entrainment member 29 is displaced laterally with respect to the clamping arm 26 and ensures that the tape is displaced over the entire width of the tape guide frame 9, with the carriage 22. If required a further entrainment member 29 can be provided on the other side of the clamping arm.

The carriage 22 and the components mounted thereon are shown in solid lines in the position in the proximity of the tape guide frame. The carriage together with the tape loop 28, the clamping arm 26 and the entrainment member 29, is shown in broken lines in the position in the proximity of the strapping plane. FIG. 9 also shows the drive 30 for moving the carriage 22 from the tape guide frame 9 to the strapping plane.

FIGS. 10 and 11 show an alternative embodiment of the system described herein. The tape drive forming the tape feed device 6 is pivotable in this embodiment.

The first pivotal position of the tape drive 6 can be seen in FIG. 10. In that position the tape drive 6 is beneath the plane of the tape guide frame 9. In that position tape is fed by the tape drive 6 to the tape guide passage of the tape guide frame 9.

In the operation of feeding the tape, the cover elements 16 are in the closed position in which they cover the tape guide passage 17 (see FIG. 4 and FIG. 7). The cover elements 16 are then displaced into the open position (see FIG. 5 and FIG. 8).

In that position the tape is ejected from the tape guide passage 17 and the tape drive 6 is pivoted into the second pivotal position.

The second pivotal position of the tape drive 6 can be seen in FIG. 11. In that position the tape drive 6 is pivoted towards the strapping plane by a small angle. In a practical embodiment that angle is 2.6°. The illustrated pivotal angle is shown on an enlarged scale in FIG. 11 for enhanced clarity. In that pivoted position the tape 2 passes into the tape drive 6 underneath the strapping plane.

The tape loop which has issued from the tape guide passage can now be retracted by the tape drive 6 until it is tightened snugly around the article 7 to be strapped. The end of the tape loop, that is joined to the tape supply, is clamped fast in the closure assembly 10 beneath the strapping plane and is severed from the tape supply. The ends are then welded together by the closure assembly 10. During that operation the tape drive can be pivoted back into the position under the tape guide frame 9 shown in FIG. 10. In the meantime the cover elements 16 have been moved back into the position shown in FIG. 7, in which they cover the tape guide passage 17. In that way a fresh tape loop can be introduced into the tape guide passage before the welding operation is concluded and the article 7 to be strapped is transported out of the strapping plane.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. Apparatus for strapping an article using a flat tape, comprising:

at least one tape guide frame having a flat tape guide passage;

a closure assembly for joining ends of the flat tape together;

a tape drive for feeding the tape into the tape guide passage;

an opening device arranged at the tape guide frame which opens a narrow side of the tape guide passage, wherein the tape drive is movable from a first position in which the tape is fed to the tape guide passage into a second position in which a tape loop formed in the tape guide passage is tightened around the article, wherein, prior to conclusion of an operation of joining the ends of the tightened tape loop together by the closure assembly, tape is freshly fed to the tape guide passage from a tape supply to form another tape loop, wherein the opening device includes at least one cover element which is movably secured to the tape guide frame, the tape guide frame being stationary, and the at least one cover element is movable from a closed position in which the at least one cover element covers the narrow side of the tape guide passage into an open position that opens the narrow side of the tape guide passage; and at least one ejector arranged on the tape guide frame, wherein the ejector being pushed into the tape guide passage to push the tape loop formed in the tape guide passage through the open narrow side out of the tape guide passage when the opening device is in the open position.

2. The apparatus according to claim 1, wherein the cover element is secured to the tape guide frame displaceably transversely relative to the flat tape guide passage.

3. The apparatus according to claim 1, wherein the cover element is secured pivotably to the tape guide frame.

4. The apparatus according to claim 1, wherein the tape guide frame includes a plurality of limbs, wherein the cover element is one of a plurality of cover elements, and wherein at least one of the plurality of cover elements is secured to each limb of the tape guide frame.

5. The apparatus according to claim 4, further comprising:

an opening drive which synchronously drives all of the plurality of cover elements.

6. The apparatus according to claim 1, wherein the tape drive is at least one of: pivotable or displaceable.

7. The apparatus according to claim 1, wherein the closure assembly is a welding device.

8. A method of strapping an article with a tape a tape strapping apparatus, the tape strapping apparatus including: at least one tape guide frame having a tape guide passage, a closure assembly for joining ends of the tape together, a tape drive for feeding the tape into the tape guide passage, an opening device arranged at the tape guide frame which opens a narrow side of the tape guide passage, and at least one ejector arranged on the tape guide frame, the method comprising:

feeding the tape to the tape guide passage from a tape supply to form a tape loop;

tightening the tape loop around the article;

cutting the tightened tape loop away from the tape supply;

joining together ends of the tightened tape loop to close the tightened tape loop, wherein, prior to the conclusion of the operation of joining the ends of the tightened tape loop together by the closure assembly, a tape is freshly fed to the tape guide passage from the tape supply to form another tape loop, wherein the tape drive is movable from a first position in which the tape is fed to the tape guide passage into a second position in which the tape loop formed in the tape guide passage is tightened around the article, wherein the opening device includes at least one cover element which is movably secured to the tape guide frame, the tape guide frame being stationary, and the at least one cover element is movable from a closed position in which the at least one cover element covers the narrow side of the tape guide passage into an open position that opens the narrow side of the tape guide passage, and wherein the ejector being pushed into the tape guide passage to push the tape loop formed in the tape guide passage through the open narrow side out of the tape guide passage when the opening device is in the open position.

9. The method according to claim 8, wherein the cover element is displaced or pivoted on the tape guide frame.

10. The method according to claim 8, wherein the at least one cover element is one of a plurality of cover elements, and the method further comprising: synchronously driving the plurality of cover elements by an opening drive.

11. The method according to claim 8, wherein the tape drive is pivoted.

12. The method according to claim 8, wherein the tape drive is displaced.

* * * * *